US008400324B1

(12) United States Patent
Jaeger

(10) Patent No.: US 8,400,324 B1
(45) Date of Patent: Mar. 19, 2013

(54) APPARATUS FOR ALERTING SHOPPERS AT A CHECKOUT REGISTER

(76) Inventor: Arthur W Jaeger, Mount Prospect, IL (US)

( * ) Notice: Subject to any disclaimer, the term of this patent is extended or adjusted under 35 U.S.C. 154(b) by 0 days.

(21) Appl. No.: 13/287,393

(22) Filed: Nov. 2, 2011

(51) Int. Cl.
*G08B 21/00* (2006.01)
*G08B 21/24* (2006.01)

(52) U.S. Cl. ..... 340/689; 340/568.5; 232/62

(58) Field of Classification Search ..... 340/568.5, 340/689; 232/1 B, 62, 63; 248/542
See application file for complete search history.

(56) References Cited

U.S. PATENT DOCUMENTS 4,723,118 A * 2/1988 Hooley et al. ..... 340/568.5
4,725,822 A * 2/1988 Hooley ..... 340/568.5
4,840,336 A * 6/1989 Stroh et al. ..... 248/97
5,131,499 A 7/1992 Hoar
6,491,218 B2 12/2002 Nguyen
6,550,583 B1 4/2003 Brenhouse
6,924,743 B2 * 8/2005 Conzola et al. ..... 340/573.1
2002/0170782 A1 * 11/2002 Millikan ..... 186/61
2005/0114216 A1 5/2005 Lantz et al.
2009/0188757 A1 * 7/2009 Cox et al. ..... 186/66

* cited by examiner

*Primary Examiner* — Daniel Wu
*Assistant Examiner* — John Bambert
(74) *Attorney, Agent, or Firm* — James Ray & Assoc

(57) ABSTRACT

An apparatus for alerting shoppers at a checkout register having a bagging station with a rotating member having at least one bag support that is capable of pivoting between a first position, wherein the support is disposed prior to loading a merchandise into an at least one bag supported on the at least one bag support, and a second position wherein the at least one bag support is tilted outwardly relative to the bagging station. The apparatus includes at least one switch in contact with the bag support and an indicator in electrical communication with the switch for indicating that the at least one bag support is disposed in the second position.

16 Claims, 6 Drawing Sheets

APPARATUS FOR ALERTING SHOPPERS AT A CHECKOUT REGISTER

FIELD OF THE INVENTION

The present invention relates, in general, to retail store checkout apparatus, and, more particularly, this invention relates to improvements to bagging station carousels.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

As is generally well known, retail store checkout counters typically have an associated bagging station where purchased goods are placed into plastic bags. Many permit only one bag at a time to be loaded. Some others have a facility enabling multiple bags to be alternatively as items are rung up, depending on the type of item and room remaining in a bag. In some instances, the bagging station is a carousel type, much like that described in U.S. Pat. No. 6,491,218 to Nguyen. This discloses a triangle-shaped carousel. A circular carousel was disclosed by Lantz et al. in U.S. Patent Application 2005/0114216 with bag hanging arms or hooks on each of the sides.

Conzolo et al. in U.S. Pat. No. 6,924,743 discloses a notification system for alerting shoppers about to leave a store without a portion of their bagged purchases. One key feature of Conzolo is a customer detector for determining if the shopper has stepped a certain distance from the bagging area. Another key feature is a merchandise detector that could be a weight detector, a video camera, or an electromechanical switch on the checkout counter. Also, the customer is not alerted until after they have stepped away from the bagging area.

Therefore, there is a need for an improved cost-effective apparatus to alert customers starting to depart a store checkout station if any of their bags are about to be left behind, particularly on a bagging carousel where they have been rotated out of sight.

SUMMARY OF THE INVENTION

The invention provides an apparatus for alerting shoppers at a checkout register having a bagging station with a rotating member having at least one bag support that is capable of pivoting between a first position, wherein the support is disposed prior to loading a merchandise into an at least one bag supported on the at least one bag support, and a second position wherein the at least one bag support is tilted outwardly relative to the bagging station. The apparatus further includes a mechanism in contact with the bag support for indicating that the at least one bag support is disposed in the second position.

In a preferred embodiment, the mechanism includes an indicator light associated with each of the bag supports so that not only is the customer and cashier aware that bagged merchandise is remaining, they can see where it is located.

OBJECTS OF THE INVENTION

It is, therefore, one of the primary objects of the present invention to provide a checkout bagging station with a built-in annunciation signal capability allowing customers to determine in a glance if all of their loaded bags have been removed from the bagging area.

Another object of the present invention is to provide a cost-effective visual and/or audio alert system for shopping bag loading carousels.

Yet another object of the present invention is to provide a bagging carousel that can alert customers to the presence of items in bags that have been rotated out of sight.

A further object of the present invention is to provide a bagging carousel alert apparatus that is independent of a building 110-volt electrical supply.

An additional object of the present invention is to provide an apparatus to alert both a customer and the bagger to the presence of a bagged item before the customer steps away. Yet a further object of the present invention is to provide an alert apparatus that not only signals that bagged merchandise has not been removed, but also at which location it is present.

Still yet another object of the present invention is to provide a remaining-bag alert system that can be readily retrofitted to existing bagging carousels.

In addition to the several objects and advantages of the instant invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
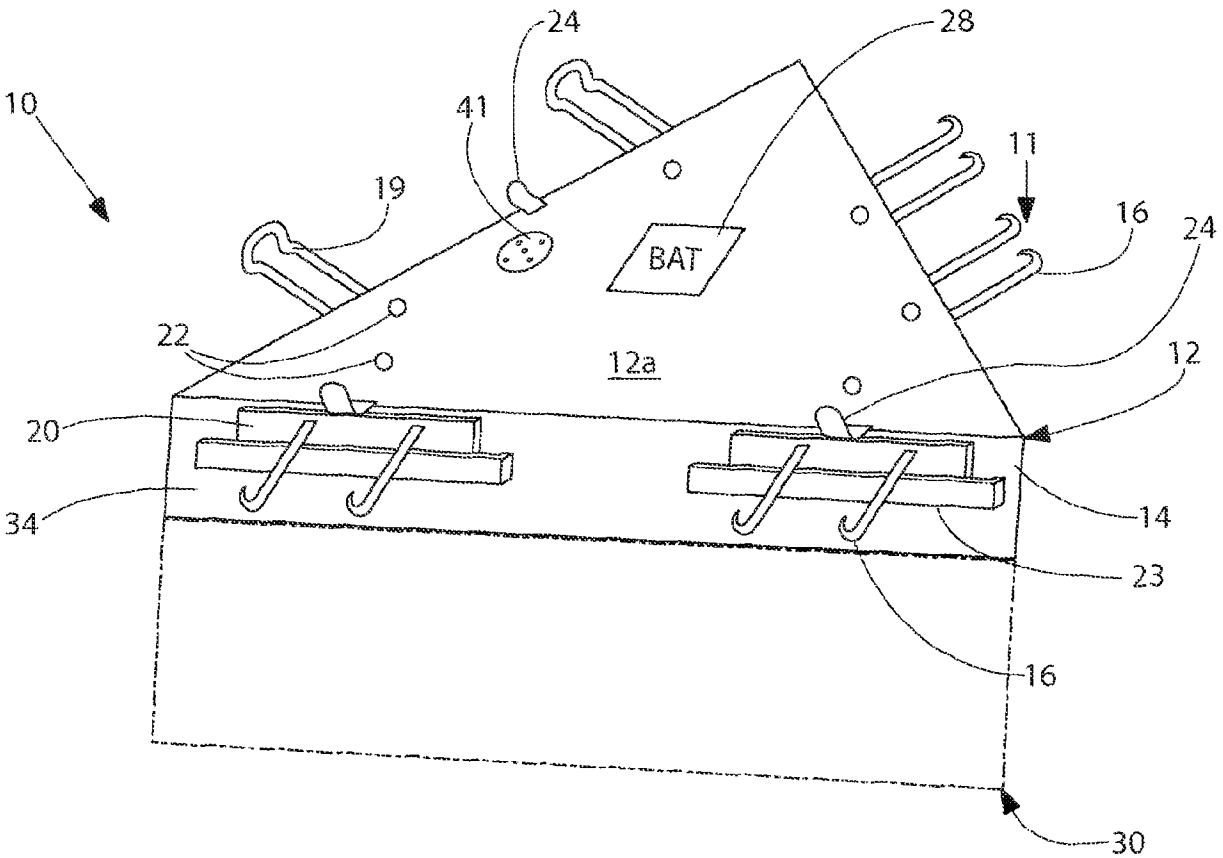
FIG. 1 provides a perspective view of the present invention.

Prior to proceeding to the more detailed description of the present invention, it should be noted that, for the sake of clarity and understanding, identical components which have identical functions have been identified with identical reference numerals throughout the several views illustrated in the drawing figures.

It is to be understood that the definition of "annunciating" applies to "indication by sight or sound".

The best mode for carrying out the invention is presented in terms of embodiments, herein depicted within FIGS. 1 through 7. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The present invention describes a device, generally designated as 10, for signaling customers at a retail checkout area with a bagging carousel that loaded shopping plastic bags are present. The present invention is illustrated and described in combination with a triangular bagging carousel, although it will be apparent to those skilled in the relevant art that the present invention may be applied to other configurations, such as circular, and as such should not be interpreted as the limiting factor of the present invention.

Reference is now made, to FIGS. 1-5, wherein the 10 is typically supported by a base 30 which has a top surface 34, preferably the same basic shape as the rotating member 12, which has a hollow interior 12*a*. The rotation of rotating member 12 can derive from spinning around a stationary base 30, or from being fixedly attached to a rotating base 30. Attached to the exterior peripheral surfaces of the rotating member 12 is at least one and preferably a plurality of bag supports 11 positioned about a circumference of the rotating member 12. Each bag support 11 has a pair of hooks disposed in a spaced apart relationship with each other. Typically, there will be a hanging tab 24 between each pair for holding a supply of fresh bags. Each of the pair of hooks is defined by a first portion 16, or alternatively 19, disposed generally horizontally during use of the each of the pair of hooks, and a second portion 15 disposed generally perpendicular to the first portion 16, the second portion 15 attached to a distal end of the first portion 16 and extending upwardly therefrom. The bag support 17 may be defined by conventional bent wire members, stamped and bent members or any other members suitable for use on bagging stations.

Each bag support 11 preferably includes a cross member 20 attached at each end thereof to a proximal end of a respective first portion 16 and disposed generally horizontally during use. Furthermore, prior to loading the bag 50, the cross member 20 is generally disposed in a first position, in close proximity to the vertical side surface 14 of the rotating member 12. The cross member 20, when under a load hanging from the first portions 16, tilts outwardly (or pivots slightly) to a second position and operates means for sensing, such as an electrical switch 37, disposed within rotating member 12 so as to operate means for annunciating, such as at least one indicator 22 having a light source energized to emit light, in response to the switch 37 sensing the at least one of said plurality of bag supports 11 being in the second position. Such light indicates to the customer and bagger that a bag 50 with purchased merchandise disposed inside thereof is still present. Preferably, the cross member 20, is made of steel such that magnets (later referenced with numerals 44 and 26*a*) will be attracted and held to them when at least close to one another. The at least one signal light 22 is preferably a colored LED energized from a power supply source, such as a battery 28, disposed within the hollow interior 12*a* and being mounted to an inner surface of the rotating member 12, although it is contemplated that the at least one signal light 22 can be electrically coupled to other power supply sources, for example employed in operating the checkout register (not shown). FIG. 1 illustrates plurality of signal lights 22, wherein each signal light 22 is positioned adjacent a respective one of the plurality of bag supports 11, which indicates to the customer and bagger that a bag 50 with purchased merchandise loaded inside is still present, and also indicates the exact position on the rotating member 12 where the bag 50 is located.

Figure 2:
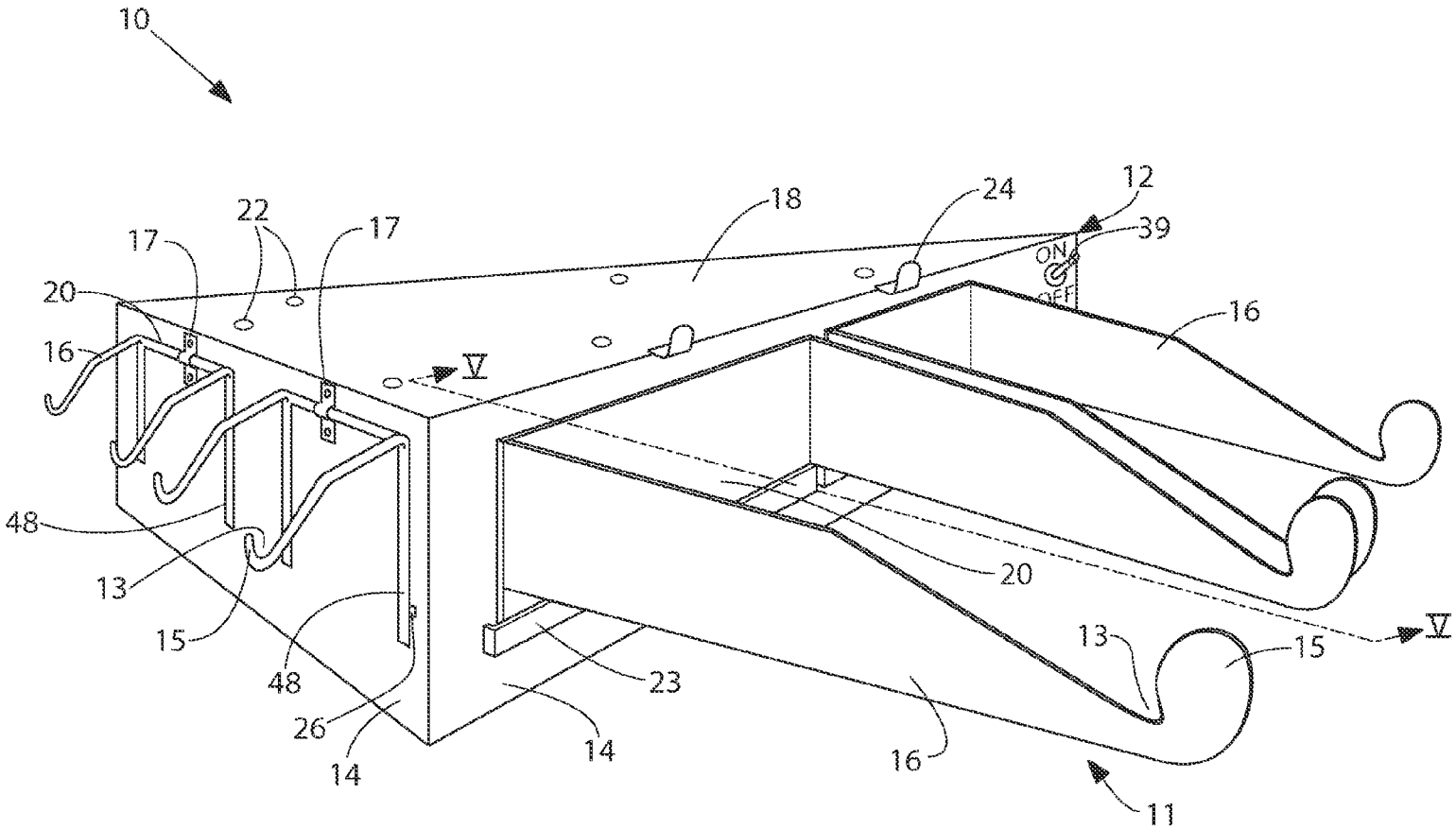
FIG. 2 is a perspective view of the top portion of the present invention.

FIG. 2 is a perspective view of the top portion of the present invention. The bag supports 11, shown in a first position, are generally provided in pairs with spaced apart first portions 16 disposed substantially normal to a cross member 20 being hingedly or otherwise pivotally attached to vertical surfaces 14 of the rotating member 12. The cross members 20 are pivotally attached such that they pivot slightly from the pull (weight) of bagged merchandise supported by the first portions 16. The pivot means may be a trough 23, provided as a channel or an angle, at the lower edge of the side wall 14 of the rotating member 12 or a hinge 17 along the top or bottom edge of the cross member 20. The hinge 17 can be of any suitable type. A stack of fresh new bags (not shown) is also held on protruding tab 24, which are an optional part of the present invention. Each bag 50 being filled with merchandise is supported from the pair of first portions 16. Preferably, the bag supports 11 have a second portion 15 with a curved tip with a pronounced C-shaped notch 13. The purpose of the C-shaped notch 13 is to combine the removal of filled bags 50 (FIGS. 4 and 5) with an upward force on the first portions 16 such as to force the cross member 20 to operate the switch 37 so as to deactivate the lights 22.

Equally as well, the instant invention contemplates that another switch 39 is provided so as to manually disconnect path of power supply to the at least one signal light 22 when the hanging member 11 is inadvertently moved into the second position. It would be appreciated that such another switch 39 will be manually operable to reconnect path of power supply to the at least one signal light 22.

Figure 3:
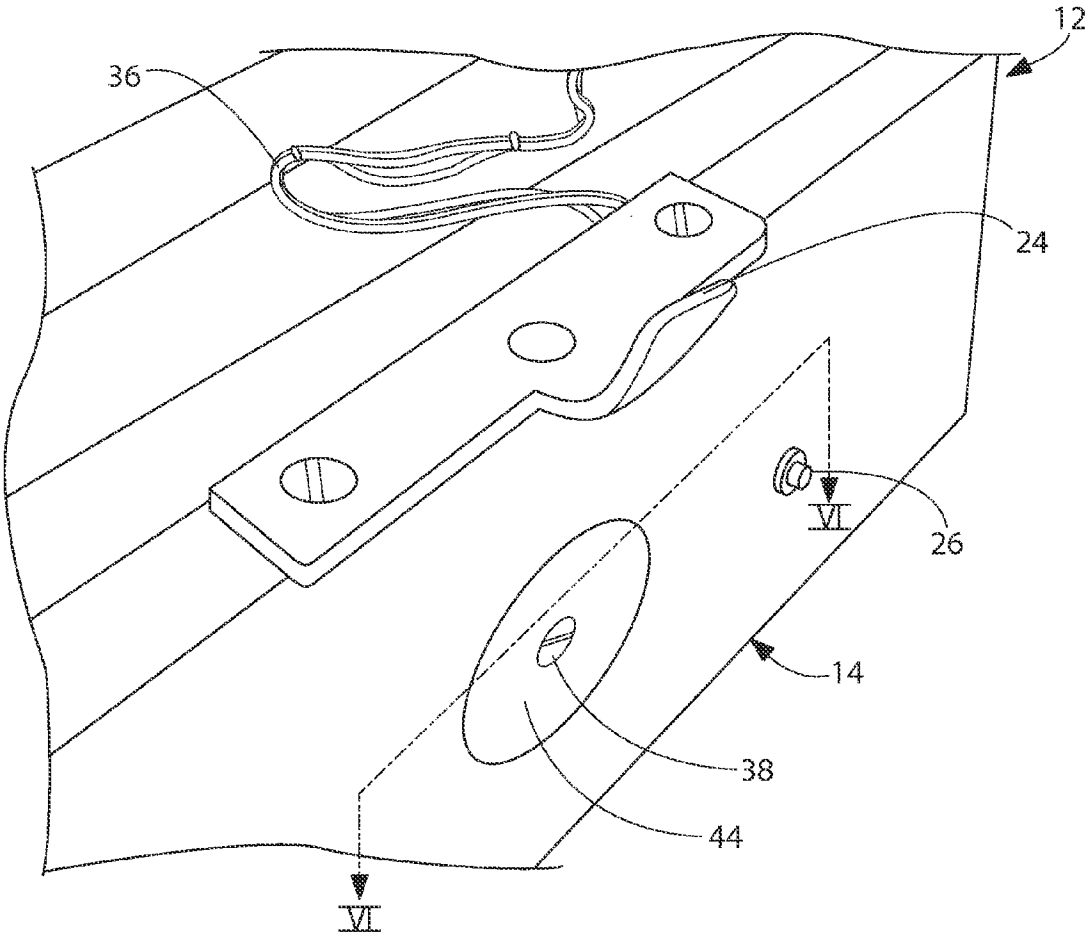
FIG. 3 provides a detailed partial perspective view of a portion of the present invention.

FIG. 3 provides a detailed partial perspective view of that portion of the present invention generally out of view, behind the cross member 20 in FIG. 2. With the cross member 20 shown as removed, switch actuator 26 protrudes through the vertical side surface 14 such that it can directly contact the cross member 20 (not shown in FIG. 3). The switch actuator 26 may be a magnet connected to a normally open electrical switch 37 when the magnet 26 is pulled to the support cross member 20. Alternatively, the switch actuator 26 is a member protruding from an interior electrical switch 37 and can be non-magnetic and a separate magnet 44 assists in urging or pulling the cross member 20 back up against the switch actuator 26 when the weight of the bags is removed. The magnet 44 may be a permanent or an electrical type, and its protrusion distance from the side wall 14 can be varied by an adjustment fastener 38, best shown in FIG. 6 so as to adjust the strength of the magnetic field.

Figure 4:
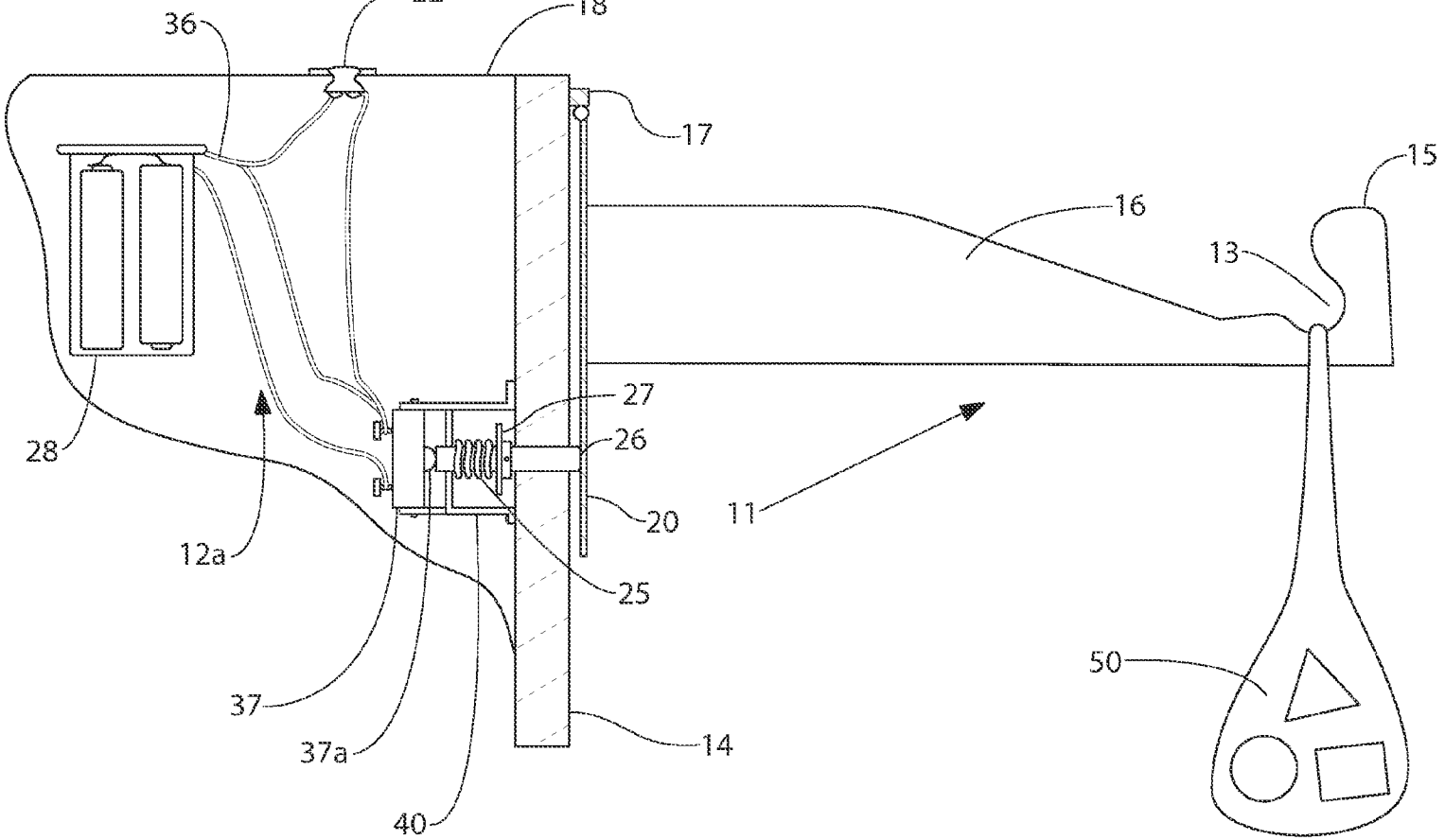
FIG. 4 is a partial sectional side view of an alternative embodiment of the present invention.

FIG. 4 is a partial sectional side view of an alternative embodiment of the present invention with the pivoting means 17 at the top of the cross member 20. The electrical switch 37 with a surface button 37*a* is attached to the interior surface of the vertical side 14 with a bracket 40. Those familiar with such switches will recognize that the switch 37 can be any of several types, including plunger activated, roller activated and leaf contact activated. The switch 37 is connected to wiring 36 powered by batteries 28, or a standard 120 V electrical supply. The switch actuator 26 is a rod which has an end portion thereof also protruding through the outer surface of vertical side wall 14 with the other end supported by the bracket 40. A spring 25 encircles an interior portion of the actuator rod 26, and an adjustment nut releasably attached to the actuator rod 26 enables the spring to be compressed by a force on the outer end, and to push the actuator rod 26 out when there is little or no pressure from cross member 20.

When a shopping bag 50 with some merchandise inside is hung adjacent the second portion 15 so that its handle portion is positioned within the notch 13, the leverage force pushes the cross member 20 against the outer end of switch actuator rod 26 compressing the spring 25 and forcing the inner end of actuator rod 26 against the button portion 37*a* of the switch 37 resulting in the lighting of indicator lamp 22. When the weight is released from the bag supports 11, the force of the spring is able to push the actuator rod 26 our against the cross member 20, which can freely pivot from the hinge 17. When the actuator rod 26 is pushed out away from the button 37*a*, the light 22 goes out.

Figure 5:
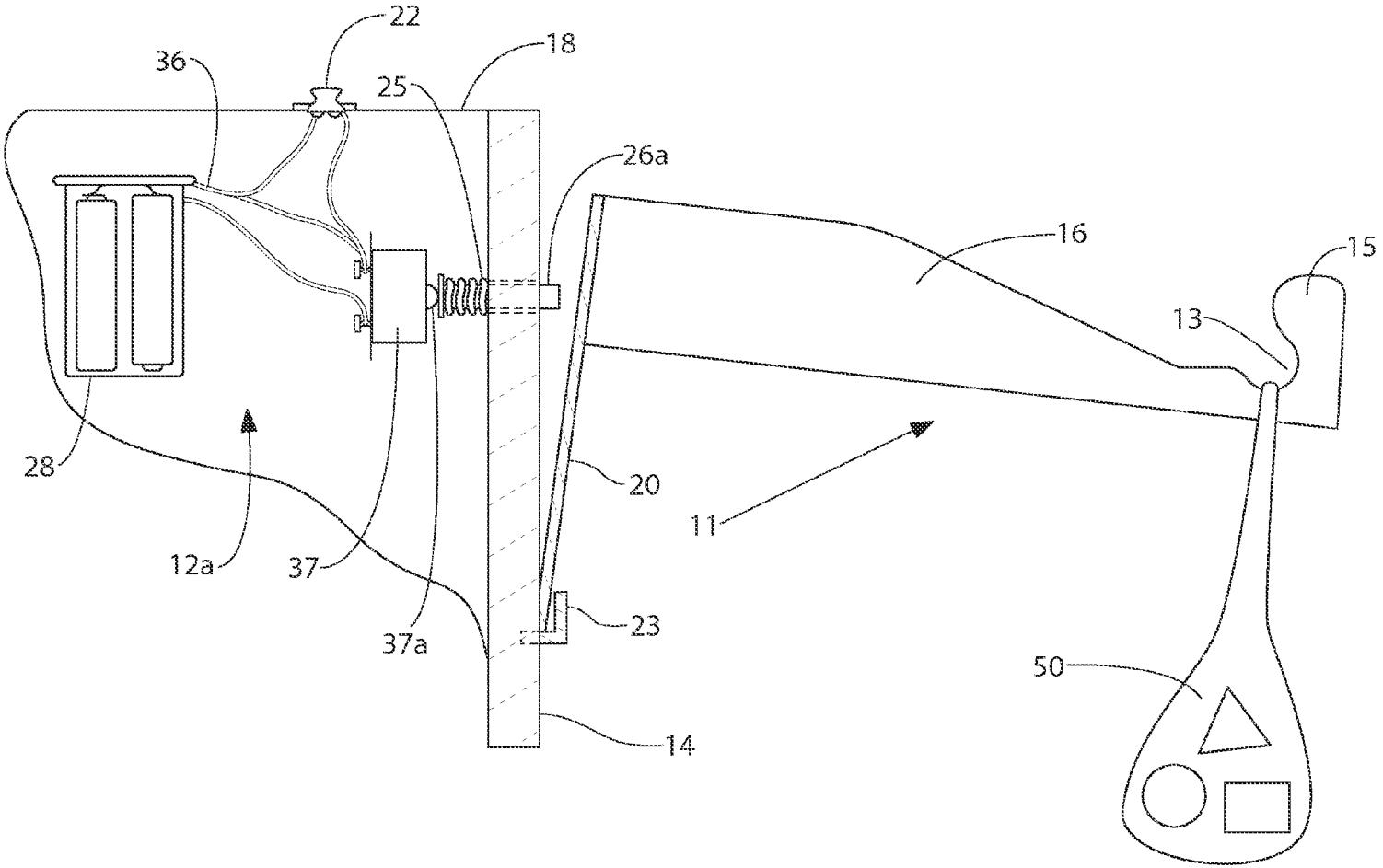
FIG. 5 provides a partial sectional side view of a preferred embodiment of the present invention along lines V-V of FIG. 2.

FIG. 5 provides a partial sectional side view of a presently preferred embodiment of the present invention with the bag supports 11 being disposed in the second position. The bottom edge of the cross member 20 is pivotally supported in an angle 23 attached to the side member 14. When a shopping bag 50 with some merchandise inside is hung adjacent the second portion 15 so that its handle portion is positioned within the notch 13, the leverage force pulls the cross member 20 away from the vertical peripheral side 14 sufficiently far to disengage cross member 20 from the magnetic member 38 and switch actuator 26. This action operates the switch 37 to energize the indicator light 22 with power from the battery 28. When the user lifts the bag 50, the handle portion disposed within generally C-shaped notch 13 acts against the second portion 15 and urges the bag support 11 to pivot counter-clock wise in FIG. 5, causing the cross-member 20 to reengage the actuator 26 and subsequently deactivate the respective indicator or signal light 22. Thus, the C-shaped notch 13 provides the means for at least urging each of the plurality of bag supports 11 into the first position when the bag 50 suspended from the each of the plurality of bag supports 11 is removed therefrom.

Figure 6:
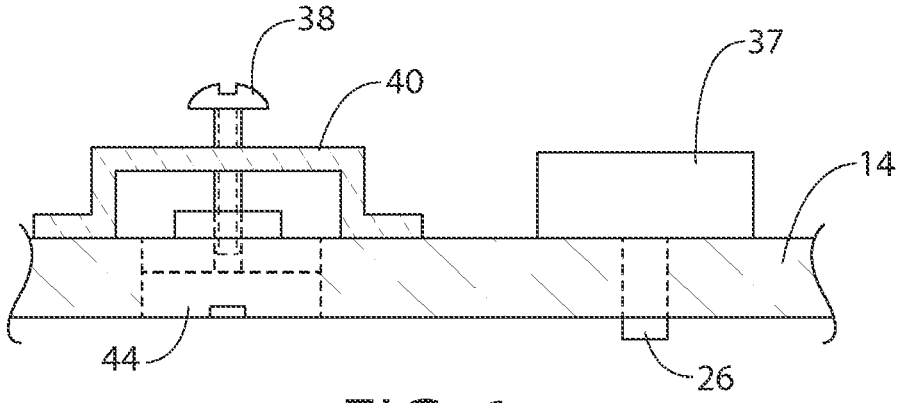
FIG. 6 provides a partial sectional plan view of a presently preferred embodiment of the present invention along lines VI-VI of FIG. 3.

FIG. 6 provides a partial sectional plan view of a portion of an embodiment of the present apparatus interior from the view VI-VI of FIG. 3. The magnet 44 can be adjusted out and in by adjustment bolt 38 through a bracket 40. When the magnet 44 pulls the cross member 20 toward the side wall 14, the actuator rod 26 is pushed in deactivating the light. Those familiar with such devices will recognize that bracket 40 and magnet 44 can take on many forms which will function equally well.

Figure 7:
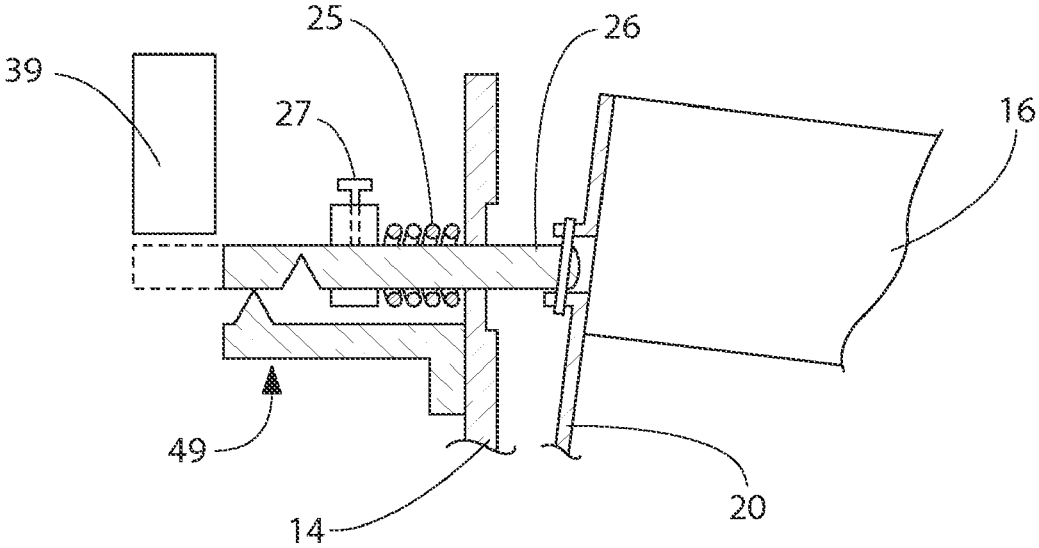
FIG. 7 provides a partial sectional side view of an embodiment of the present apparatus.

FIG. 7 provides a partial sectional side view of an alternative embodiment of the present invention along lines similar to that of FIG. 5. The switch actuator rod 26*a* is physically attached, in a pivoting manner, at an outer end thereof to the cross member 20, and a compression coil spring 25 around the rod 26*a* is compressed between the inner surface of the side wall 14 and adjustment member 27. Adjacent the inner end of rod 26*a*, a detent mechanism 49 inhibits, but does not prevent, the sliding of the rod 26*a*. When a load on member 16 pulls cross member 20 away from side wall 14 to a second position, the actuator rod 26*a* is pulled out and away from the switch 39 activating the annunciating means. When the load is released, the compression spring 25 urges the switch actuator rod 26*a* and cross member 20 back to a first position wherein the detent mechanism 49 is activated so as to temporarily secure the bag supports 11 in such first position. The switch 39 is shown as being of a proximity sensor type. Such sensor can replace switch 37 in FIGS. 4-7 through employment of suitable mounting members. The mechanically centered detent mechanism 49 replaces the above described magnet 44.

It is also within the scope of the instant invention to provide annunciating means, such as an audible annunciator 41, either instead of or in addition to the at least one signal light 22.

It would be appreciated that instant invention, employing battery 28 affords ease of retrofit of the rotating member 12 presently in use, however the apparatus 10 can be connected to other power sources, for example that are used to operate the checkout register (not shown) associated with the bagging carrousel.

Furthermore, although the instant invention has been illustrated in combination with a rotating carrousel having plurality of bag supports, the instant invention is suitable for use with a single bagging station of a stationary, non-rotating type. Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. An apparatus for alerting shoppers at a checkout register having a bagging station with at least one bag support, said apparatus comprising:

(a) means for pivoting the at least one bag support between a first position wherein a portion of the at least one bag support is disposed generally perpendicular to a vertical surface of the bagging station prior to loading a merchandise into an at least one bag supported on the at least one bag support and a second position wherein the at least one bag support is tilted outwardly relative to a vertical plane of the bagging station so that one end of the portion of the at least one bag support is separated a distance from said vertical surface of the bagging station; and (b) means for annunciating the at least one bag support being disposed in said second position.

2. The apparatus, according to claim 1, wherein said means for annunciating is at least one light in electrical communication with a switch responsive to said bag support being disposed in one of said first and second positions.

3. The apparatus, according to claim 1, wherein said pivoting means includes a hinge.

4. The apparatus, according to claim 1, wherein said annunciating means includes at least one indicator having a light source energized to emit light in response to said sensing means operable to sense said at least one of said plurality of bag supports being in said second position.

5. An apparatus for alerting shoppers at a checkout register, said apparatus comprising:

(a) a bagging carousel including a base and a rotating member;

(b) a plurality of bag supports positioned about a circumference of said rotating member, each of said plurality of bag supports including a pair of hooks disposed in a spaced apart relationship with each other, each of said pair of hooks having a first portion disposed generally horizontally, a second portion disposed generally perpendicular to said first portion, said second portion attached to a distal end of said first portion and extending upwardly therefrom, said each of said plurality of bag supports further including a cross member attached at each end thereof to a proximal end of a respective first portion and disposed generally horizontally;

(c) one of a channel and an angle attached to said surface of said rotating member and said cross member having an edge portion thereof being so sized and positioned within said channel or angle that said cross member is allowed to pivot relative to said surface of said rotating member between a first position wherein said cross member is disposed adjacent a surface of said rotating member and a second position wherein said cross member separates a distance from said surface of said rotating member; and (d) means for at least urging said each of said plurality of bag supports into said first position when a bag suspended from said each of said plurality of bag supports is removed therefrom;

(e) means for sensing position of said each of said plurality of bag supports; and (f) means for annunciating said each of said plurality of bag supports being disposed in said second position.

6. The apparatus, according to claim 5, wherein said at least urging means includes a generally C-shaped notch positioned within a juncture of said first and second portions, said notch is so sized that a handle thickness portion of the bag fits therewithin during a merchandise loading effort, and wherein said notch causes upward movement of said each of said pair of hooks when the bag is removed therefrom.

7. The apparatus, according to claim 5, wherein said sensing means includes an elongated magnetic member in communication with said means for annunciating, said elongated magnetic member mounted for linear movement in a direction being generally perpendicular to said cross member.

8. The apparatus, according to claim 5, wherein said sensing means includes at least one switch disposed for direct engagement with said cross member being disposed in said first position in said close proximity to said surface.

9. The apparatus, according to claim 5, wherein said means for at least urging includes a magnetic member adjustably disposed in said rotating member in a position to engage said cross member.

10. The apparatus, according to claim 9, wherein said magnetic member further includes an adjustment fastener for at least temporarily fixing said magnetic member in said position to engage said cross member.

11. The apparatus, according to claim 5, wherein said means for at least urging includes a detent mechanism operable to temporarily secure said each bag support in said first position.

12. The apparatus, according to claim 5, wherein said annunciating means includes an audible member operable in response to said sensing means sensing said at least one of said plurality of bag supports being in said second position.

13. The apparatus of claim 5, further including a power source disposed within or on said rotating member in electrical communication with said sensing and annunciating means.

14. The apparatus of claim 5, further including a switch manually operable to selectively activate or terminate operation of said sensing and annunciating means.

15. An apparatus for alerting shoppers at a checkout register having a rotating bagging carousel, said apparatus comprising:

(a) a rotating member fixedly attached to such rotating bagging carousel;

(b) a plurality of bag supports positioned about a circumference of said rotating member, each of said plurality of bag supports including a pair of hooks disposed in a spaced apart relationship with each other, each of said pair of hooks having a first portion a second portion disposed generally perpendicular to said first portion, said second portion attached to a distal end of said first portion and extending vertically therefrom, said each of said plurality of bag supports further including a cross member attached at each end thereof to a proximal end of a respective first portion and disposed generally horizontally;

(c) an electrical switch for sensing position of said each of said plurality of bag supports;

(d) a sensor actuator rod disposed through a wall of said rotating member, wherein an outer end of said actuator rod is proximal one of said second portion and said cross member and an inner end is proximal said electrical switch;

(e) means disposed on an outer surface of said rotating member for pivoting said each of said plurality of bag supports between a first position relative to said surface of said rotating member and a second position relative to said surface;

(f) means in contact with one of said second portion and said cross member for urging said each of said plurality of bag supports into said first position when a bag suspended from said each of said plurality of bag supports is removed therefrom;

(g) means in communication with said electrical switch for annunciating said each of said plurality of bag supports being disposed in said second position.

16. The apparatus, according to claim 15, wherein said urging means is a coil spring adjustably held in compression.

* * * * *